US011834215B2

(12) United States Patent
Tervoort et al.

(10) Patent No.: US 11,834,215 B2
(45) **Date of Patent: *Dec. 5, 2023**

(54) CSIP-COLLECTOR WITH DUAL DOCKING FUNCTION

(71) Applicant: JBT Food & Dairy Systems B.V., Amsterdam (NL)

(72) Inventors: Arjan Tervoort, Haarlem (NL); Marijn Luijten, Haarlem (NL)

(73) Assignee: JBT Food & Dairy Systems B.V., Amsterdam (NL)

( * ) Notice: Subject to any disclaimer, the term of this patent is extended or adjusted under 35 U.S.C. 154(b) by 34 days.

This patent is subject to a terminal disclaimer.

(21) Appl. No.: 17/584,209

(22) Filed: Jan. 25, 2022

(65) Prior Publication Data

US 2022/0144470 A1 May 12, 2022

Related U.S. Application Data

(63) Continuation of application No. 16/597,541, filed on Oct. 9, 2019, now Pat. No. 11,235,898.

(30) Foreign Application Priority Data

Oct. 10, 2018 (NL) ..... 2021786

(51) Int. Cl.
*B65B 55/02* (2006.01)
*B65B 9/06* (2012.01)
*B65B 39/12* (2006.01)

(52) U.S. Cl.
CPC ..... *B65B 55/02* (2013.01); *B65B 9/06* (2013.01); *B65B 39/12* (2013.01)

(58) Field of Classification Search
CPC ..... B65B 55/02; B65B 9/06; B65B 39/12; B65B 55/103; B65B 9/20; B65B 3/04; B65B 65/00; B65B 55/00
See application file for complete search history.

(56) References Cited

U.S. PATENT DOCUMENTS 3,086,336 A * 4/1963 Rausing ..... B65B 55/04 493/212
3,164,936 A * 1/1965 Loliger ..... B65B 55/06 53/551

(Continued)

FOREIGN PATENT DOCUMENTS

WO 2017/220688 A1 12/2017

*Primary Examiner* — Thomas M Wittenschlaeger
*Assistant Examiner* — Katie L Gerth
(74) *Attorney, Agent, or Firm* — CHRISTENSEN O'CONNOR JOHNSON KINDNESS PLLC

(57) ABSTRACT

An aseptic packaging machine includes a web-shaped packaging material feed, a sterilizer-filler nozzle assembly with a form section 40, a product supply duct, a sterilization medium supply duct, and an exhaust duct. One or more pre-sterilization medium supply feeds are connectable to a product inlet connector and a sterilization medium inlet connector. A collector cup 70 is movable relative to the nozzle assembly between an inactive and a docking position. The collector cup delimits one or more interior spaces 71*a*, 72*a* designed to, in the docking position, enclose a product outlet portion 4 to collect and/or drain away pre-sterilization media during a pre-sterilization of the nozzle assembly get to flow through and along it, and to also enclose the sterilization medium outlet portion 16 and/or exhaust inlet portion 22 in the docking position inside its one or more interior spaces.

17 Claims, 11 Drawing Sheets

(56) References Cited

U.S. PATENT DOCUMENTS

| | | | | | |
|---|---|---|---|---|---|
| 4,055,035 | A * | 10/1977 | Sjostrand | B65B 55/103 | 53/167 |
| 4,784,697 | A * | 11/1988 | Bordini | B67C 3/002 | 53/551 |
| 4,900,527 | A * | 2/1990 | Lierke | B65B 55/10 | 361/228 |
| 5,044,140 | A * | 9/1991 | Iwano | B67C 3/002 | 141/90 |
| 5,335,479 | A * | 8/1994 | Lemke | B65B 55/02 | 53/551 |
| 5,431,198 | A * | 7/1995 | Turtchan | B65B 55/02 | 222/255 |
| 6,035,614 | A * | 3/2000 | Gustafsson | B65B 39/00 | 53/551 |
| 8,201,594 | B2 * | 6/2012 | Martin | B65B 55/00 | 141/90 |
| 2004/0200188 | A1 * | 10/2004 | Hoeppner | B65B 3/04 | 53/283 |
| 2005/0076612 | A1 * | 4/2005 | Andersson | B65B 55/103 | 53/551 |
| 2005/0126117 | A1 * | 6/2005 | Benedetti | B65B 55/103 | 53/551 |
| 2011/0185686 | A1 * | 8/2011 | Konno | B29C 65/7451 | 53/548 |
| 2020/0140133 | A1 * | 5/2020 | Overhuijs | B65B 55/103 | |

* cited by examiner

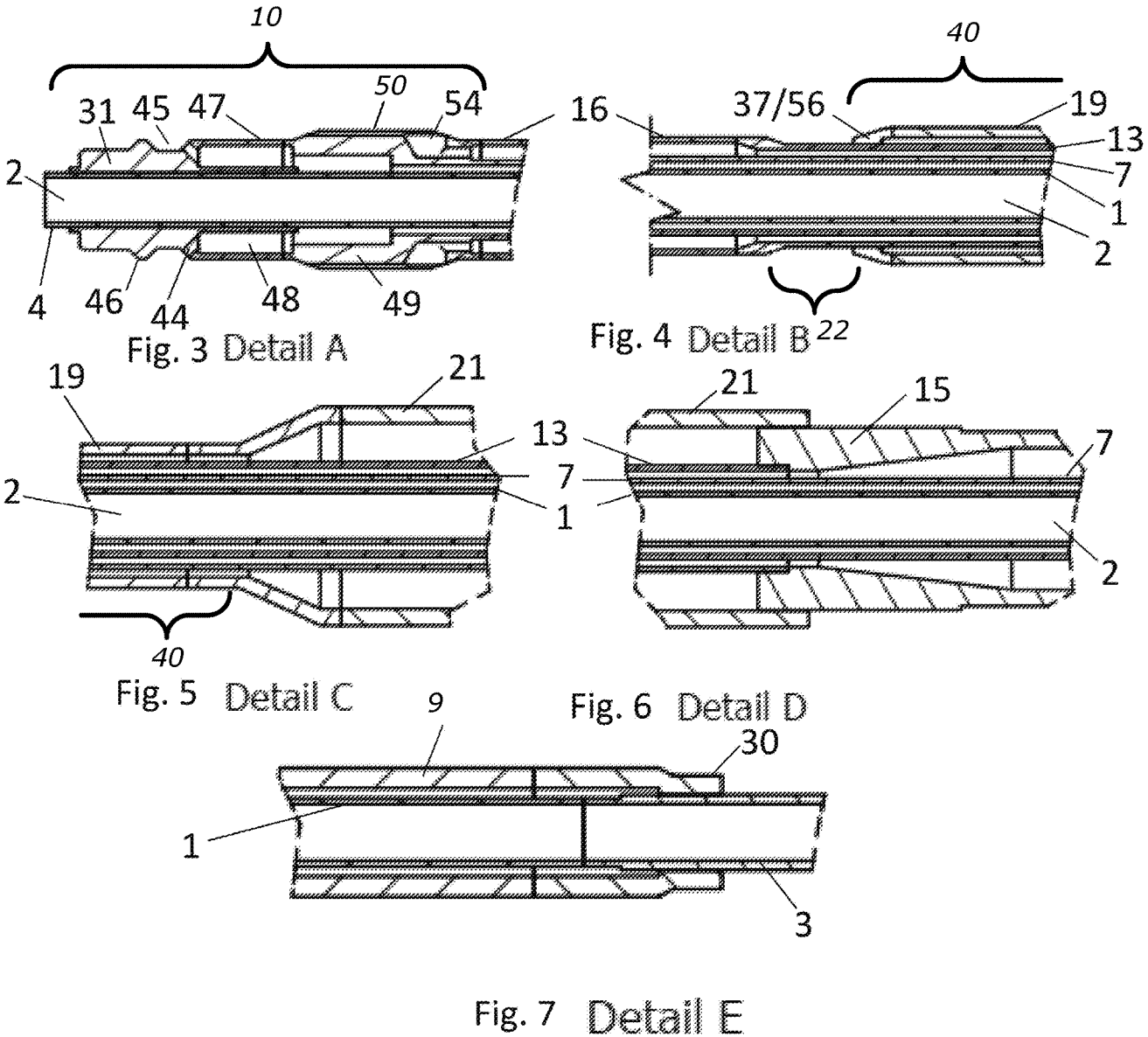
10
40
50
54
49
48
47
45
44
31
46
2
4
16
37/56
19
13
7
1
2
22
Fig. 3 Detail A
Fig. 4 Detail B
21
15
7
2
13
7
1
19
2
40
Fig. 5 Detail C
30
9
1
3
Fig. 6 Detail D
Fig. 7 Detail E

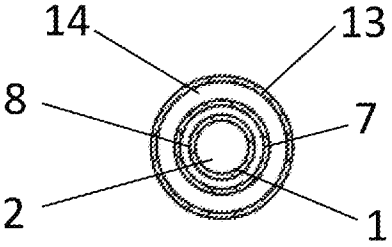
Fig. 9 Section G-G
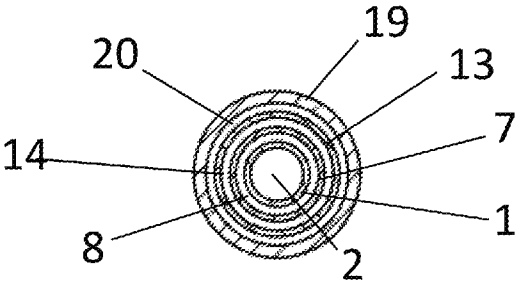
Fig. 8 Section F-F
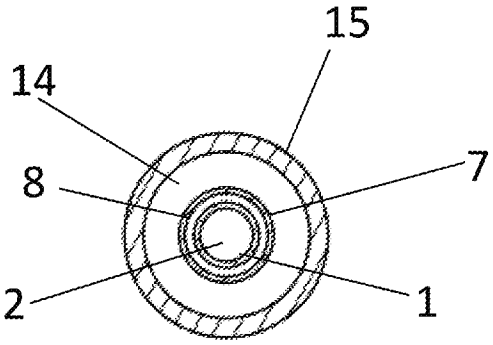
Fig. 10 Section H-H

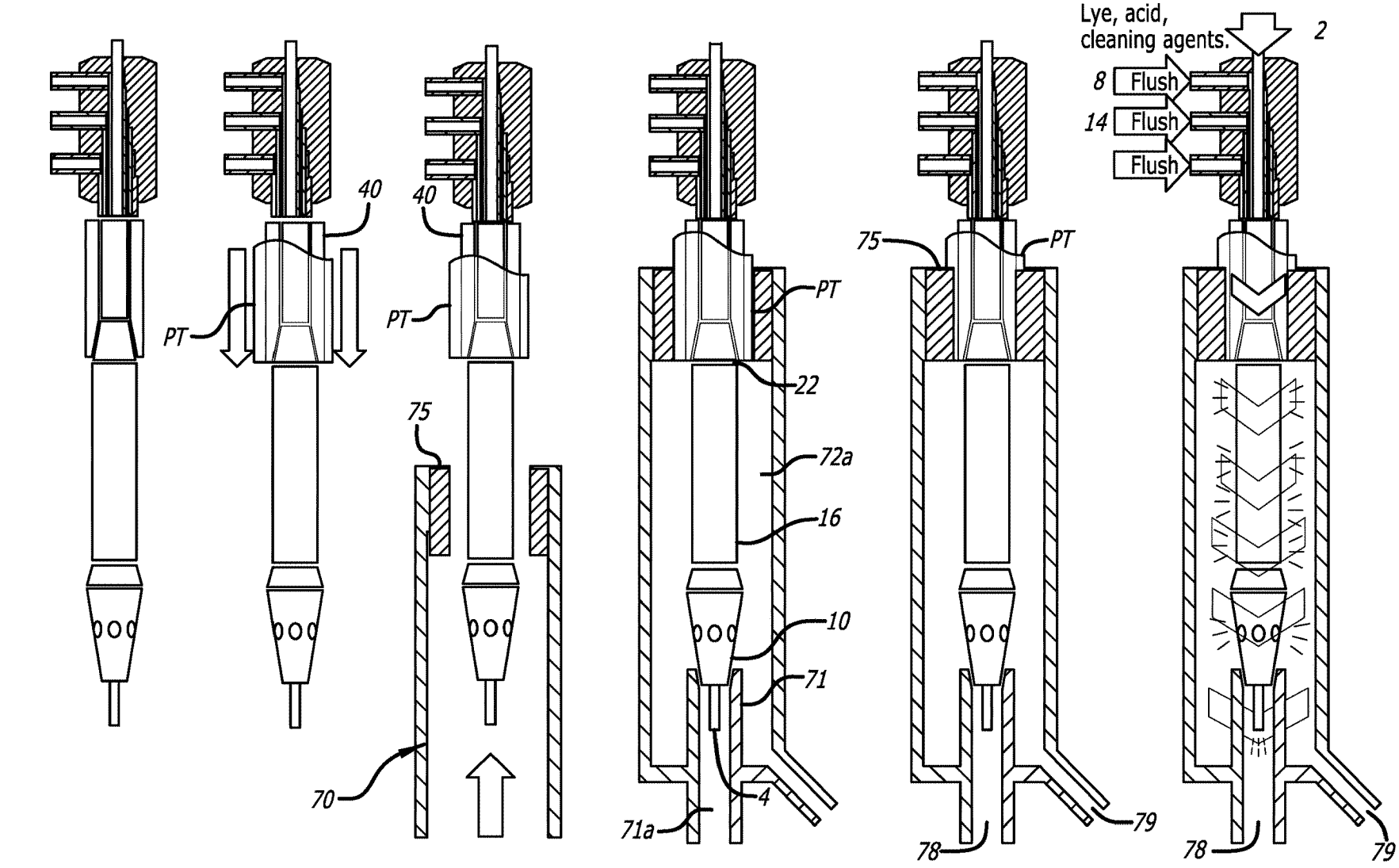
FIG. 14.1
FIG. 14.2
FIG. 14.3
FIG. 14.4
FIG. 14.5
FIG. 14.6
PT
40
75
70
22
72a
16
10
71
4
71a
78
79
2
Lye, acid, cleaning agents.
8
14
Flush
Flush
Flush

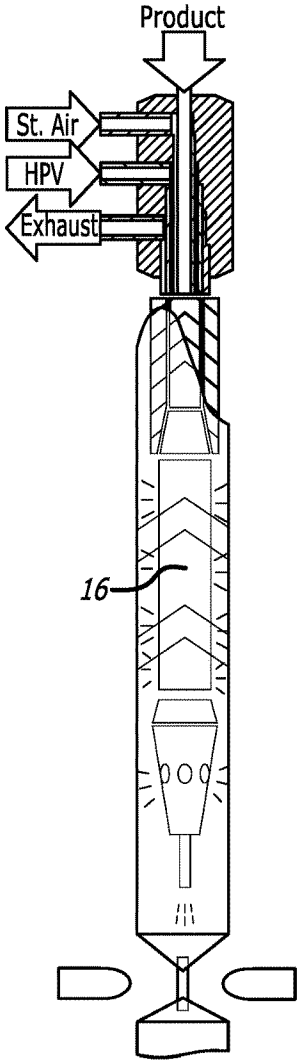
FIG. 14.11
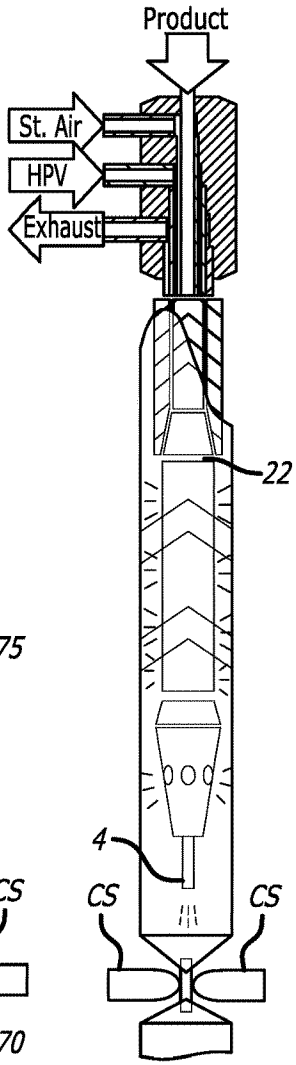
FIG. 14.10
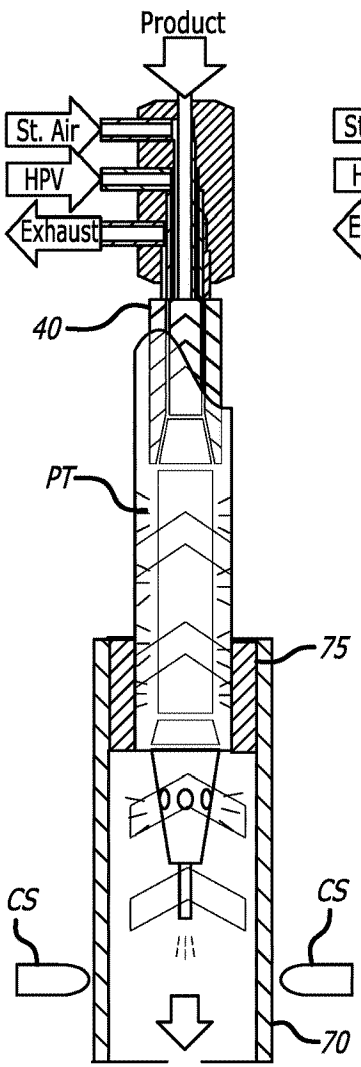
FIG. 14.9
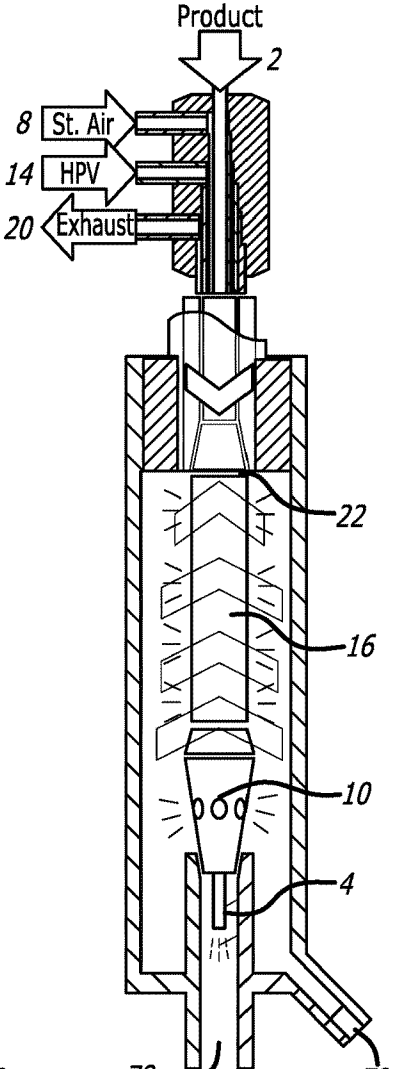
FIG. 14.8
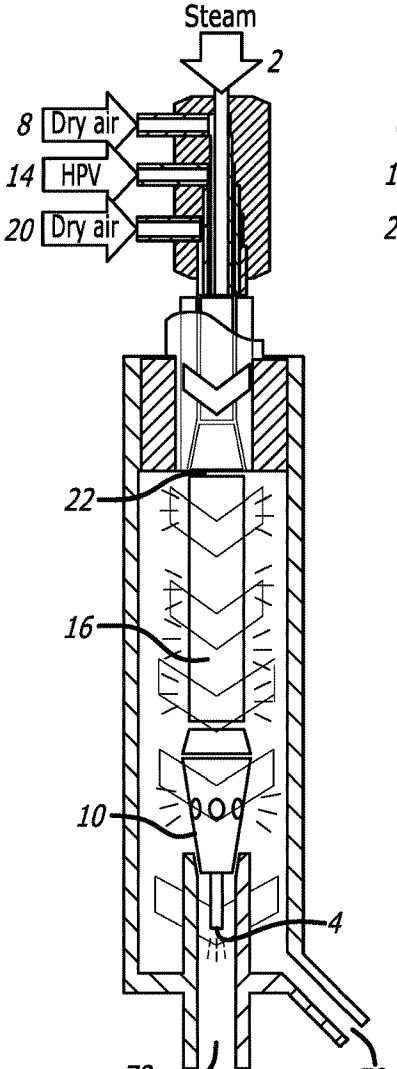
FIG. 14.7

CSIP-COLLECTOR WITH DUAL DOCKING FUNCTION

CROSS-REFERENCES TO RELATED APPLICATIONS

This application is a continuation of U.S. patent application Ser. No. 16/597,541, filed Oct. 9, 2019 (now U.S. Pat. No. 11,235,898), which claims priority under 35 U.S.C. § 119 to NL Patent Application No. 2021786, filed Oct. 10, 2018, and the entire contents of both applications are hereby incorporated by reference.

BACKGROUND

The invention relates to an aseptic packaging machine that has one or more sterilizer-filler nozzle assemblies, in particular of a type that comprises a form section that has an outer wall, a proximal end and a distal end, which outer wall is designed to form a packaging tube out of a web-shaped packaging material around the outer wall while the packaging tube moves downstream and while the packaging tube gets sealed along a longitudinal edge.

Such sterilizer-filler nozzle assemblies for example can be used for aseptically packaging quantities of sterile products, like liquid food products, in sterile sealed packaging tubes, for example sticks. With this the packaging material may get sterilized before the packaging tube gets filled with the sterile product.

This sterilization for example can be done by guiding the web-shaped material through a bath filled with sterilization medium and then have the thus wetted packaging material run through the sterile zone of the aseptic packaging machine towards the form section. See for example U.S. Pat. No. 4,055,035. A disadvantage hereof was that the relatively large sterile zone of such machine needed to be pre-sterilized and kept sterile during the entire packaging process.

From WO 2017/220688 it is known to have the sterilization of the packaging material take place after the forming of the packaging tube. Thus a lot of equipment of the packaging machine no longer had to be pre-sterilized and kept aseptic during the entire packaging process. For being able to perform the sterilization inside the packaging tube, a sterilizer-filler nozzle assembly is provided that comprises a central product dispensing pipe that is partly surrounded by a cylindrical plasma mist dispensing pipe that has an open end adjacent an open end of the dispensing packaging tube. The plasma mist dispensing pipe provides a tapered or stepped construction to a forming pipe about which the packaging material is folded into its packaging tube-shape and is sealed along a longitudinal edge. Cold plasma mist gets dispensed to flow along and sterilize the packaging material right after it has been formed in the packaging tube-shape and just before it comes into contact with the sterile product. The plasma mist dispensing pipe is partly surrounded by the forming pipe that has an open end adjacent the open end of the plasma mist dispensing pipe. The forming pipe here serves the purpose of inlet pipe for extraction of the plasma mist out of the formed packaging tube again.

From U.S. Pat. No. 5,335,479 it is known to perform a pre-sterilization of a form pipe and fill pipe before a filling operation begins. The form pipe and fill pipe then get pre-sterilized by having different kinds of sterilization medium flowing through and around them. For this use is made of a cup-shaped connecting element. During pre-sterilization, the cup-shaped connecting element gets brought in line with and connected to a lower end of the fill pipe. Subsequently, a lower section of a formed packaging tube gets manually pulled down and positioned around an outwardly projecting upper edge of the cup-shaped connecting element. In this docking position the formed packaging tube gets clamped around this edge by means of a tension ring. In this engaged docking position, a cleaning medium, first, and then for a pre-determined period of time a pre-sterilization medium, preferably steam, are carried through the fill pipe, sterilizing the inside thereof. The pre-sterilization medium that emerges from the fill pipe is caught by the cup and removed therefrom via an outlet opening into a drain. A pre-sterilization medium, such as hydrogen peroxide, is introduced through a distal lower end of the form pipe into the packaging tube interior between an outer wall of the fill pipe and an inner wall of the formed packaging tube. The pre-sterilization medium also gets into a gap between the packaging tube and the form pipe through longitudinal grooves that are provided along the form pipe. After a certain period of time, the feed of pre-sterilization medium is switched off, and the fill pipe is moved towards an upper position. Sealing jaws are then pressed together, so that between the fill pipe and the cup, they seal the packaging tube.

A disadvantage herewith is that the pre-sterilization process leaves to be improved. In particular it strongly delimits the type of packaging material and/or pre-sterilization media that can be used. When for example hydrogen peroxide suspended in steam is used as pre-sterilization medium for the pre-sterilization of the outer wall of the fill pipe and of the form pipe, then this hot mixture also gets to flow directly along the inner wall of the formed packaging tube. In order to prevent the formed packaging tube of starting to shrink and/or having the characteristics of its packaging material negatively influenced, it is important not to use too hot or aggressive chemicals in the pre-sterilization medium for pre-sterilizing the outer wall of the fill pipe and of the form pipe, and it is important to use a packaging material of which the inner wall is well able to withstand high temperatures and/or chemicals in the pre-sterilization medium. Another disadvantage is that, when for example hot steam is used as pre-sterilization medium for pre-sterilization of a product supply duct inside the fill pipe, then the fill pipe as well as the cup-shaped connecting element for a long period of time can remain way too hot to be able to manually safely pull a free lower end of a formed packaging tube down along and over the fill pipe and carefully manually position and clamp it around the upper edge of the cup-shaped connecting element. A cooling period might then be required, which may lead to valuable production time getting lost. Yet another disadvantage is that the manually pulling down of the formed packaging tube along the fill pipe and positioning and clamping it around the connection element, brings along risks for an operator to get injured and increases a risk of contamination of the critical filling zone by the operator. Further it is disadvantageous that the manual pulling down of the packaging tube may lead to the packaging tube getting accidentally damaged, which may cause the pre-sterilization medium to leak prematurely away into the machine itself during the pre-sterilization process, that is to say without having been able to sufficiently pre-sterilize the entire critical filling zone. Finally it is also deemed disadvantageous that the pre-sterilization medium that is introduced through the distal lower end of the form pipe into the packaging tube interior between an outer wall of the fill pipe and the inner wall of the formed packaging tube, gets exhausted at the distal end of the form section at substantially the same position as where the pre-sterilization medium has been injected. This may result in either an amount of pre-sterilization medium getting to a standstill inside the lower end of the packaging tube, or in the pre-sterilization medium getting sucked upwards prematurely, that is to say before sufficiently having reached and thus be able to pre-sterilize the lower end of the fill pipe at all.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

The present invention aims to at least partly overcome those disadvantages or to provide a usable alternative. In particular the invention aims to provide an improved aseptic packaging machine in which a pre-sterilization of a sterilizer-filler nozzle assembly thereof can be performed at high speed, in an efficient and economic manner while at a same time being able to obtain a high level of sterilization for the sterilizer-filler nozzle assembly.

This aim is achieved by means of the aseptic packaging machine according to claim 1.

This machine comprises:

a web-shaped packaging material feed;

at least one sterilizer-filler nozzle assembly that comprises:

a form section that has an outer wall, a proximal end and a distal end, which outer wall is designed to form a packaging tube out of the web-shaped packaging material around the outer wall while the packaging tube moves downstream and while the packaging tube gets sealed along a longitudinal edge;

a product supply duct that extends at least partly through the form section;

has a product inlet connector which lies upstream of the distal end of the form section; and has a product outlet portion which lies downstream of the distal end of the form section;

a sterilization medium supply duct that extends at least partly through the form section;

has a sterilization medium inlet connector which lies upstream of the distal end of the form section; and has a sterilization medium outlet portion which lies between the distal end of the form section and the product outlet portion; and an exhaust duct that extends at least partly through the form section;

has an exhaust outlet connector which lies upstream of the distal end of the form section; and has an exhaust inlet portion which lies between the distal end of the form section and the product outlet portion, one or more pre-sterilization medium supply feeds that is/are connectable to the product inlet connector and the sterilization medium inlet connector; and a collector cup that is movable relative to the nozzle assembly between an inactive position and a docking position, in which the collector cup delimits one or more interior spaces that is/are designed to, in the docking position, enclose the product outlet portion to collect and/or drain away pre-sterilization media that during a pre-sterilization of the nozzle assembly get to flow through and along it. According to the inventive thought the collector cup is further designed to also enclose the sterilization medium outlet portion and/or exhaust inlet portion in said docking position inside its one or more interior spaces.

Thus according to the invention both a product outlet portion and a sterilization medium outlet portion and/or an exhaust inlet portion get enclosed by the collector cup during a pre-sterilization phase. This for the first time makes it possible to truly efficiently pre-sterilize only a limited well-defined filling zone of the nozzle assembly without having to make use of packaging material for delimiting part of that critical filling zone that needs to be pre-sterilized. The filling zone here may comprise the product outlet portion, the sterilization medium outlet portion and/or the exhaust inlet portion. By equipping the collector cup with the one or more interior spaces for enclosing not only the product outlet portion but also for enclosing the sterilization medium outlet portion and/or exhaust inlet portion, a number of important advantages can be obtained.

Firstly it makes it possible to use more vulnerable types of packaging material and/or hotter and/or better cleansing types of pre-sterilization media. The pre-sterilization media no longer get to flow directly along the inner wall of an already formed packaging tube. The formed packaging tube therefore does not get a chance of starting to shrink and/or have the characteristics of its packaging material negatively influenced. The use of hotter and/or better cleansing types of pre-sterilization media may help to increase the level of pre-sterilization and/or may help to be able to speed up the pre-sterilization process.

The packaging material can now be of all kinds, but preferably can be a film or of a laminated material.

Furthermore it is now well possible to use hot steam as pre-sterilization medium for sterilization of the product supply duct inside the fill pipe. An intermediate cooling period during subsequent phases of the pre-sterilization process is no longer necessary.

The invention also makes a safer and cleaner pre-sterilization process possible. A manual pulling down of the packaging tube and having to position it narrowly fitting around an edge and then clamp it around this edge, is not necessary and thus decreases a risk of an operator accidentally contaminating the critical filling zone of the nozzle assembly just before or during the pre-sterilization process.

The invention also makes it possible to have the pre-sterilization medium that has gotten to flow through and along the nozzle assembly, to be automatically collected and/or drained away at a downstream position. This also may help to guarantee that the pre-sterilization medium can reliably get to flow through and along the entire critical filling zone of the nozzle assembly, that is to say along at least the product outlet portion, the sterilization medium outlet portion and/or along the exhaust inlet portion thereof during the pre-sterilization phase.

The pre-sterilization media that during one or more phases of the pre-sterilization process get used to flush/flow through and along the critical filling zone of the nozzle assembly, can be of all kinds, but preferably can be of a type that get heated to a temperature of at least 45 degrees Celsius in order to be able to fulfil the pre-sterilizing requirements.

In particular, the pre-sterilization medium can be formed by a gaseous medium, like steam and/or Hydrogen Peroxide Vapor (HPV), which is obtained from a heated solution of liquid H2O2 and water. With that the steam then can be of a temperature of at least 130 degrees Celsius, whereas the HPV can be of a temperature of at least 45 degrees Celsius.

More in particular, the pre-sterilization medium that gets to flow through the product supply duct, including through and along its product outlet portion, can then be formed by the steam, whereas the pre-sterilization medium that gets to flow through the sterilization medium supply duct, including through and along its sterilization medium outlet portion, can then be formed by the Hydrogen Peroxide Vapor (HPV).

If desired, a cleaning process of the critical filling zone can be performed preceding the pre-sterilization process thereof. For that the machine may comprise one or more cleaning medium supply feeds that is/are connectable to the product inlet connector and the sterilization medium inlet connector. The cleaning media that during one or more phases of the cleaning process get used to flow/flush through and along the critical filling zone of the nozzle assembly, can be of all kinds, but preferably can be of a type that get heated to a temperature of at least 60 degrees Celsius in order to be able to fulfil the pre-cleaning requirements.

In particular, the cleaning medium can be formed by a liquid medium, like cold or hot water, or a cleansing agent or detergent, as for example ones comprising a lye or an acid.

Thus a lot of contamination can already be disposed of, which shall help to speed up and improve the subsequent pre-sterilization process.

In a preferred embodiment, the collector cup may comprise an operable gripper that is designed to, in the docking position, releasably grip a section of the formed packaging tube, for example, the free end of a formed packaging tube, that lies along the form section. The provision of such an operable gripper on the collector cup makes it advantageously possible to releasably grip the formed packaging tube in an automated manner for positioning operations. The gripper preferably gets operated by means of a control and a drive.

Furthermore, the operable gripper then may comprise opposing arcuate parts that may be semi-cylindrical in form, that are designed to, in the docking position, together grip around the form section onto the formed packaging tube that lies along the form section. With this a small play may remain between the formed packaging tube and the form section. As long as an overpressure of the pre-sterilization media is present inside the one or more interior spaces during the pre-sterilization phase, no contaminations are able to enter into the critical filling zone. Thus the operable gripper is able to quickly and easily substantially close off the one or more interior spaces in the docking position. The pre-sterilization media can then be supplied pressurized to the product outlet portion and sterilization medium outlet portion while being able to build up sufficient overpressure inside the one or more interior spaces during the pre-sterilization process.

The operable gripper can be of all kinds, like for example one that makes use of vacuum, frictional or clamping forces, or combinations thereof. In particular, the operable gripper may comprise opposing jaw parts that are designed to, in the docking position, together clamp the sealed longitudinal edge of the formed packaging tube. This makes it possible to exert large clamping forces onto the formed packaging tube without running the risk of deforming the packaging tube or damaging its outer side.

In addition thereto or in the alternative, the collector cup may be movable relative to the nozzle assembly from the docking position towards the inactive position along the product outlet portion and the sterilization medium outlet portion and/or exhaust inlet portion while having the gripper pull the formed packaging tube along with it over the product outlet portion and the sterilization medium outlet portion and/or exhaust inlet portion. Thus, a positioning of the formed packaging tube around the critical filling zone at the end of the pre-sterilization process, can take place in an automated manner that can even be made integral with a moving of the collector cup from out of its docking position back towards its inactive position in which it is set away spaced from the nozzle assembly. More importantly, it advantageously makes it possible to seamlessly keep the pre-sterilized critical filling zone fully intact when going on from the pre-sterilization phase towards the actual production phase. After the pre-sterilization phase has been completed, the pre-sterilized critical filling zone can advantageously be maintained aseptic during the production by means of the sterilization medium outlet portion getting supplied with a suitable sterilization medium, like the abovementioned HPV, such that all formed packaging tube that passes along that part of the filling zone gets sterilized.

In an embodiment, the collector cup may delimit a first and second one of the interior spaces, wherein the first interior space is designed to, in the docking position, enclose the product outlet portion, and wherein the second interior space is designed to, in the docking position, enclose the sterilization medium outlet portion and/or exhaust inlet portion. This advantageously makes it possible to use distinctive different cleaning and/or pre-sterilization media that are optimized for the cleaning and/or pre-sterilization of their own respective portions of the nozzle assembly.

Furthermore, the first interior space then may be equipped with a first drain, for example for draining the cleaning media and/or pre-sterilization media that during the cleaning and/or pre-sterilization of the nozzle assembly get to flow/flushed through and along the product outlet portion, whereas the second interior space then may be equipped with a second drain, for example for draining the cleaning media and/or pre-sterilization media that during the cleaning and/or pre-sterilization of the nozzle assembly get to flow/flush through and along the sterilization medium outlet portion and/or exhaust inlet portion. This advantageously makes it possible to have the distinctive different cleaning and/or pre-sterilization media drained of separately.

In addition thereto or in the alternative, the collector cup may be provided with a sealing element that is positioned at a transitional wall part of the collector cup that separates the first and second ones of the interior spaces from each other and that is designed to come to lie sealing around and against an outer circumferential wall part of the nozzle assembly that lies between the product outlet portion and the sterilization medium outlet portion and/or exhaust inlet portion. Thus it can be guaranteed that any pressurized injected pre-sterilization medium in the one interior space can be kept fully separated from any pressurized injected pre-sterilization medium in the other interior space.

In an embodiment, the sterilization medium outlet portion may be enclosed by an inner circumferential wall part of the collector cup that has an inner diameter that is at least 2 times larger than a largest cross-sectional dimension of the sterilization medium outlet portion. This has the advantage that the cleaning and/or pre-sterilization media are well able to flow around and along the sterilization medium outlet portion and thus have it properly and thoroughly cleaned and/or pre-sterilized.

During pre-sterilization, the exhaust outlet portion can be connected to an exhaust drain for draining of at least some of the used pre-sterilization media that have gotten injected via one or more of the supply ducts of the nozzle assembly. This makes it possible to efficiently drain of pre-sterilization medium at a position along the critical to be pre-sterilized filling zone that is suitably spaced from where they have been injected along that zone.

In an embodiment, the sterilizer-filler nozzle assembly may further comprise:

a gas supply duct that extends at least partly through the form section;

has a gas inlet connector which lies upstream of the distal end of the form section; and has a gas outlet portion which lies between the sterilization medium outlet portion and the product outlet portion, wherein the collector cup is further designed to also enclose the gas outlet portion inside its one or more interior spaces.

In a further embodiment, the gas outlet portion may lie upstream adjacent the product outlet portion. In the pre-sterilization phase it is then possible to not only have the pre-sterilization medium injected via the sterilization outlet portion but also via the gas outlet portion. This may help to further improve the level of pre-sterilization not only along the entire pre-sterilization outlet portion but also directly upstream adjacent the product outlet portion.

In addition thereto, the sterilization medium outlet portion then may lie upstream adjacent the gas outlet portion and the exhaust inlet portion then may lie upstream adjacent the sterilization medium outlet portion. This may help to further improve the level of pre-sterilization because an exhausting of injected pre-sterilization medium then may take place upstream directly above where the pre-sterilization medium has gotten injected.

The form section, the product outlet portion, the gas outlet portion, the sterilization medium outlet portion and the exhaust inlet portion of the nozzle assembly may all extend in a same axial direction. The same then may go for the collector cup. This makes a compact assembly possible. At the end of the pre-sterilization phase, the collector cup then may be forced to move away from its docking position while pulling the formed packaging tube to leave the form section where it has been formed and sealed, and further downstream in the axial direction along the product outlet portion, the gas outlet portion, the sterilization medium outlet portion and the exhaust inlet portion.

Furthermore, the form section, the product outlet portion, the gas outlet portion, the sterilization medium outlet portion and the exhaust inlet portion then may all extend in a same vertical direction. This makes it possible to optimally profit from gravitational forces.

Further preferred embodiments are stated in the subclaims.

The invention also relates to a method for pre-sterilization of an aseptic packaging machine.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIGS. 3-7 show an enlarged partial views of the details A-E in FIGS. 2*a*, 2*b*, 2*c*, and 2*d;*

FIGS. 8-10 show cross-sectional views over the lines F-H in FIGS. 2*a*, 2*b*, 2*c*, and 2*d;*

FIGS. 14.1-14.11 show subsequent phases of a cleaning phase, a pre-sterilization phase, and a production phase for the sterilizer-filler nozzle assembly of FIG. 13.

DETAILED DESCRIPTION

Figure 1A:
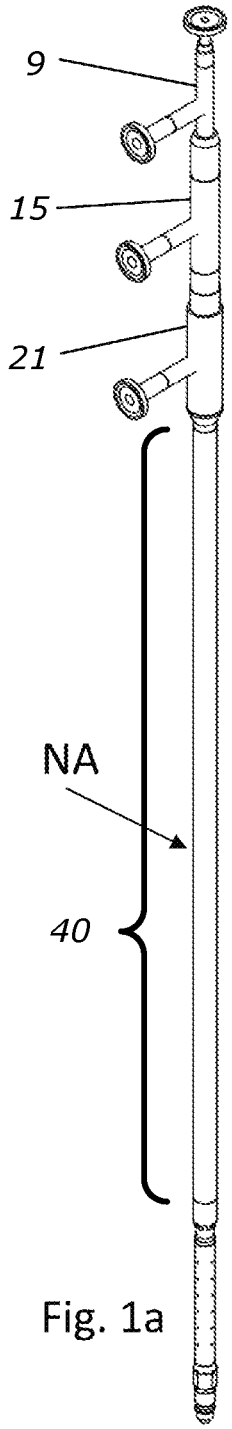
FIGS. 1*a*, 1*b*, and 1*c* show a perspective view and enlarged partial views of an embodiment of a sterilizer-filler nozzle assembly according to the invention.
Figure 1C:
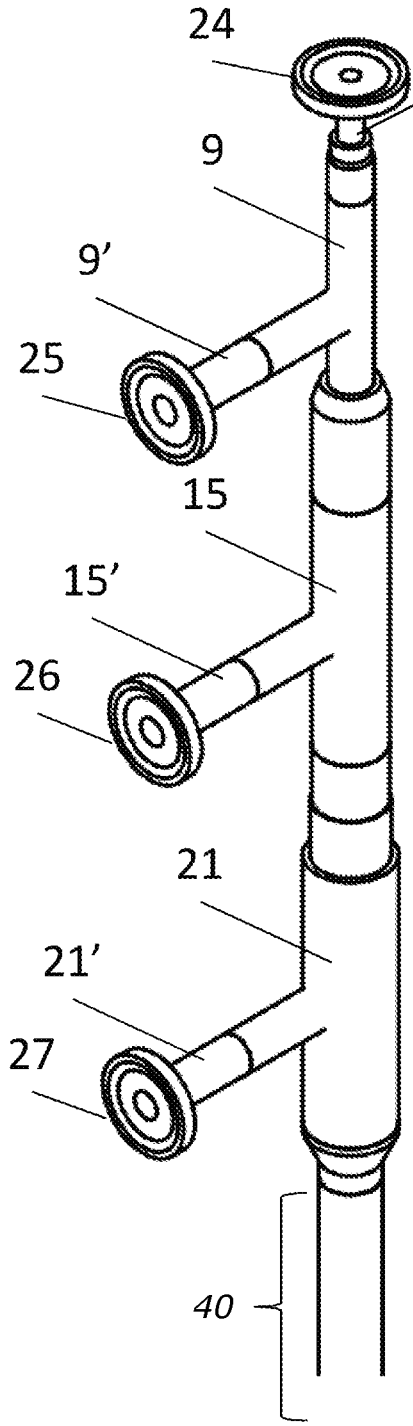

In FIGS. 1*a*-10 the sterilizer-filler nozzle assembly comprises a first pipe that has been indicated with the reference numeral 1. A product supply duct 2 is delimited by the first pipe 1. The first pipe 1 extends along an axial direction y and has a central axis. A product inlet connector 3 is provided at a proximal end of the first pipe 1. A product outlet portion 4 is provided at a distal end of the first pipe 1.

The first pipe 1 is enveloped over an intermediate part, that lies in between its product inlet connector 3 and its product outlet portion 4, by a second pipe 7. A gas supply duct 8 is delimited in between the first and second pipe 1, 7. The second pipe 7 also extends along the axial direction y and has the same central axis as the first pipe 1. A gas inlet connector 9 is provided at a proximal end of the second pipe 7. A gas outlet portion 10 is provided at a distal end of the second pipe 7.

The second pipe 7 is enveloped over an intermediate part, that lies in between its gas inlet connector 9 and its gas outlet portion 10, by a third pipe 13. A sterilization medium supply duct 14 is delimited in between the second and third pipe 7, 13. The third pipe 13 also extends along the axial direction y and has the same central axis as the first and second pipe 1, 7. A sterilization medium inlet connector 15 is provided at a proximal end of the third pipe 13. A sterilization medium outlet portion 16 is formed by a distal end of the third pipe 13.

The third pipe 13 is enveloped over an intermediate part, that lies in between its sterilization medium inlet connector 15 and its sterilization medium outlet portion 16, by a fourth pipe 19. An exhaust duct 20 is delimited in between the third and fourth pipes 13, 19.

The fourth pipe 19 also extends along the axial direction y and has the same central axis as the first, second and third pipe 1, 7, 13. An exhaust outlet connector 21 is provided at a proximal end of the fourth pipe 19. An exhaust inlet portion 22 is provided at a distal end of the second pipe 7.

The product inlet connector 3, the gas inlet connector 9, the sterilization medium inlet connector 15 and the exhaust outlet connector 21 are each provided with a connection flange 24-27 for connecting them respectively to a pressurized product supply feed, a pressurized gas supply feed, a pressurized sterilization medium supply feed and a vacuum exhaust drain of an aseptic packaging machine.

The gas inlet connector 9, the sterilization medium inlet connector 15 and the exhaust outlet connector 21 each have their connection flanges 24-27 provided at sideways projecting connector parts 9', 15', 21'.

The second pipe 7 is kept centered around the first pipe 1 while leaving free the gas supply duct 8 between them, by means of the gas inlet connector 9 resting with a radially inwardly projecting side wall 30 upon an outer circumferential wall part of the product inlet connector 3 (see FIG. 7), as well as by means of the gas outlet portion 10 resting with a radially inwardly projecting side wall 31 upon an outer circumferential wall part of the product outlet portion 4 (see FIG. 3).

Figure 1B:
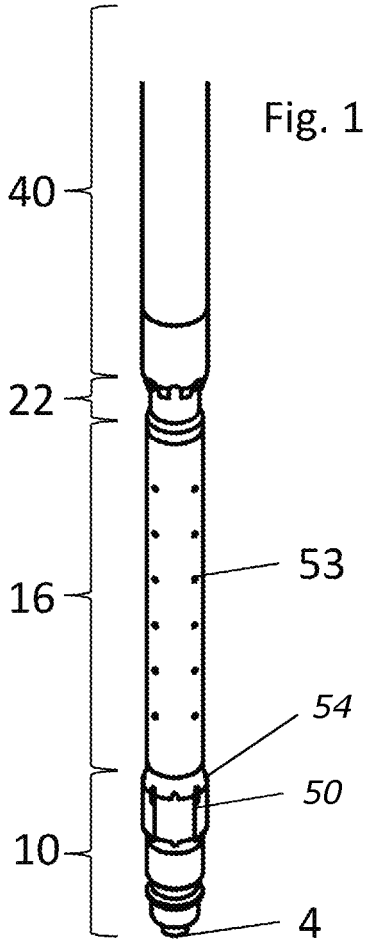
Figure 2A:
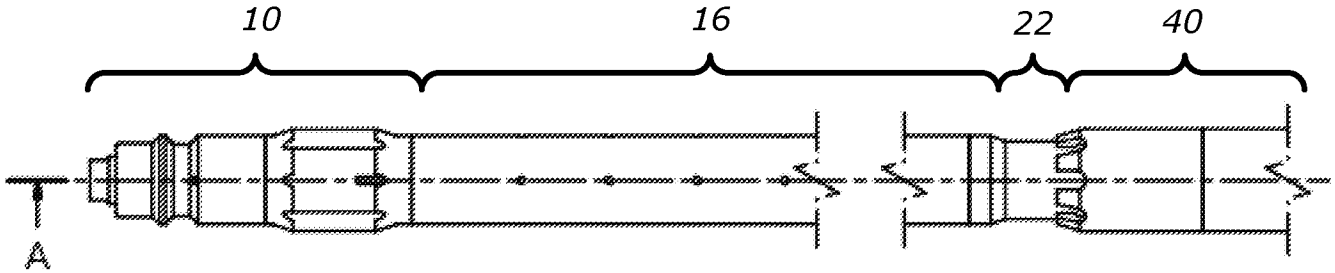
FIGS. 2*a*, 2*b*, 2*c*, and 2*d* show a front view and a longitudinal sectional view over the line A of the distal end of FIG. 1*b* and the proximal end of FIG. 1*c;*
Figure 2B:
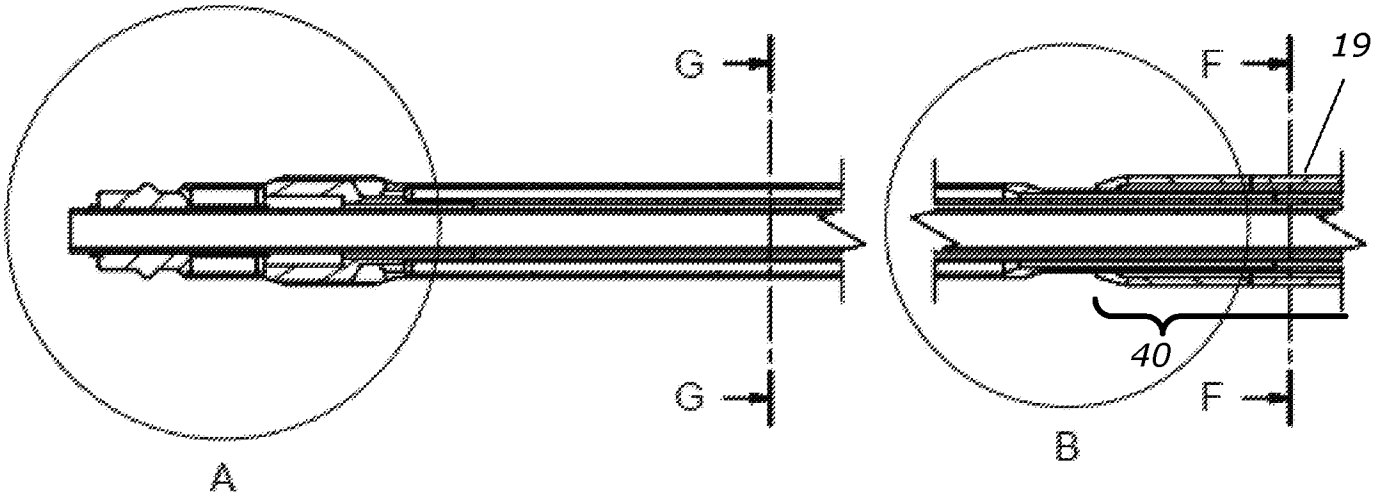
Figure 2C:
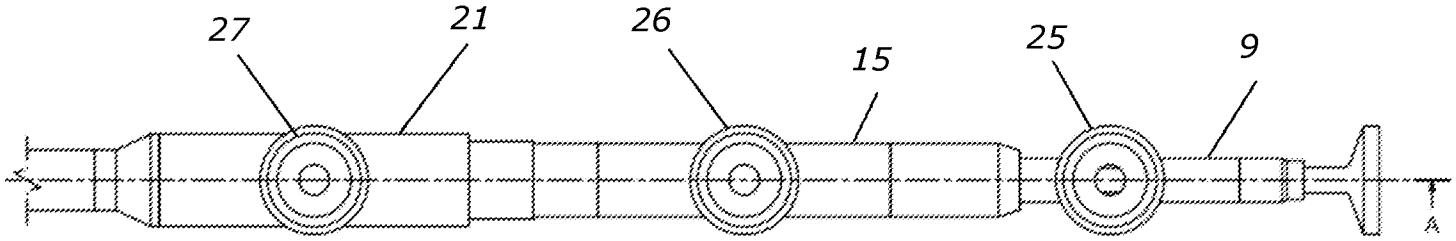

The third pipe 13 is kept centered around the second pipe 7 while leaving free the sterilization medium supply duct 14 between them, by means of the sterilization medium inlet connector 15 resting with a radially inwardly projecting side wall 33 upon an outer circumferential wall part of the gas inlet connector 9 (see FIGS. 1*c*, 2*c*, and 2*d*), as well as by means of a distal end of the sterilization medium outlet portion 16 being fixedly connected to a proximal end of the gas outlet portion 10 (see FIGS. 1*b*, 2*a*, and).

The fourth pipe 19 is kept centered around the third pipe 13 while leaving free the exhaust duct 20 between them, by means of the exhaust outlet connector 21 resting with a proximal end upon a distal end of an outer circumferential wall part of the sterilization medium inlet connector 15 (see FIG. 6), as well as by means of the exhaust inlet portion 22 resting with a radially inwardly projecting side wall 37 upon an outer circumferential wall part of the third pipe 13 adjacent a proximal end part of the sterilization medium outlet portion 16 (see FIG. 4).

The outer cylindrical wall of the fourth pipe 19 provides a form section 40 (see FIGS. 1*a*, 1*b*, 2*a*, 2*b*, 2*d*, 4, and 5). During operation, a packaging tube out of a web-shaped packaging material is formed around this wall while having the formed packaging tube move downstream, in the axial direction y from a proximal end of the form section 40 where the forming of the packaging tube starts towards a distal end of the form section 40 where the forming of the packaging tube is completed. During the packaging tube-forming process around the form section 40, abutting longitudinal edge parts of the web-shaped packaging material get sealed to each other, for example thermo-sealed by means of a sealer of the packaging machine that is positioned sideways of the form section. The thus formed and sealed longitudinal edge is also referred to as a fin seal. During this forming of the web-shaped packaging material into the tube-shape, a driving force gets exerted onto the packaging material for moving it downstream along the nozzle assembly. This can be done intermittently or continuously at a constant speed.

The product outlet portion 4 here is formed by a cylindrical distal end part of the first pipe 1. The gas outlet portion 10 lies upstream adjacent the product outlet portion 4. The gas outlet portion 10 comprises a plurality of gas outlet holes 44 around its circumference that are directed inclined forward (see FIG. 3). In front of the gas outlet holes 44 a circumferential gutter 45 is provided. In front of the gutter 45 a circumferential ridge 46 is provided. Behind the gas outlet holes 44 a cylindrical section 47 is provided that delimits a gas supply chamber 48 that connects the gas supply duct 8 to the gas outlet holes 44. Behind the cylindrical section 47 an air-cushion section 49 is provided. The air-cushion section 49 has a larger diameter than the cylindrical section 47 that in turn has substantially the same diameter as the one at which the gas outlet holes 44 open out. The air-cushion section 49 comprises a plurality of gas guiding grooves 50 (see FIGS. 1*b*and 3) that extend in the axial direction y.

Figure 2D:
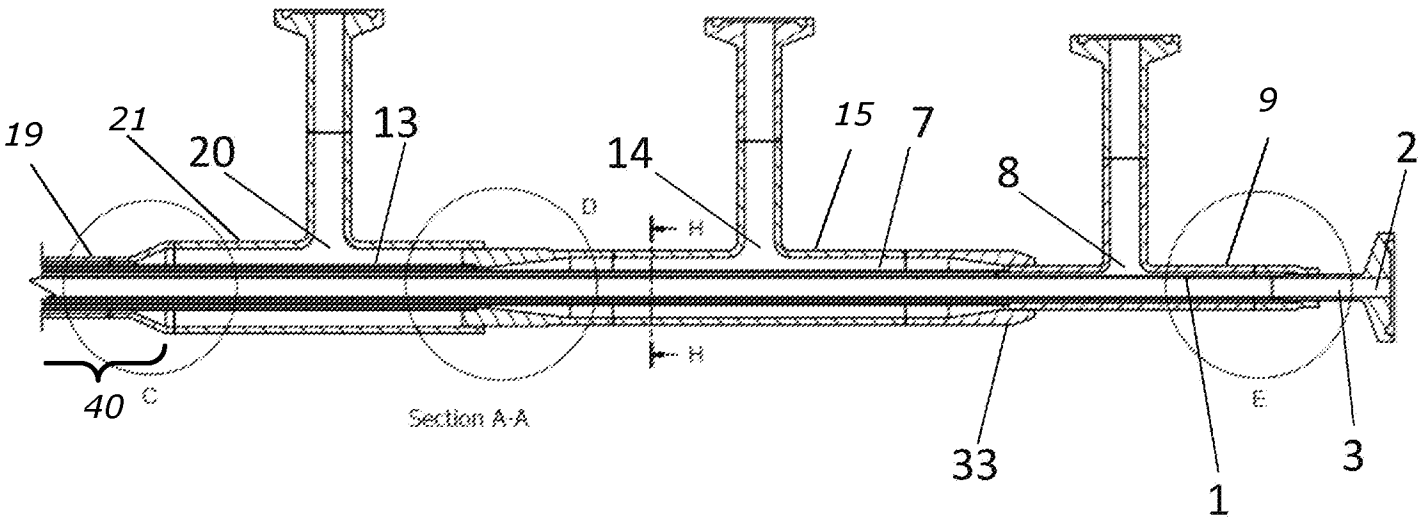

The sterilization medium outlet portion 16 lies upstream adjacent the gas outlet portion 10 and provides a cylindrical sterilization zone along which a plurality of primary sterilization medium outlet holes 53 are provided that connect to the sterilization medium supply duct 14, see FIG. 2*d*.

The cylindrical sterilization zone has a diameter that is smaller than the diameter of the air-cushion section 49. The sterilization medium supply duct 14 also connects to a plurality of secondary sterilization medium outlet holes 54 that are provided around a circumference of a proximal end of the air-cushion section 49 while opening out inside proximal ends of the grooves 50 that are provided therein. Both the primary sterilization medium outlet holes 53 as well as the secondary sterilization medium outlet holes 54 are directed radially outward.

The exhaust inlet portion 22 lies upstream adjacent the sterilization medium outlet portion 16 and comprises a plurality of exhaust inlet holes 56 around its circumference that each connect to the exhaust duct 20.

Figure 11:
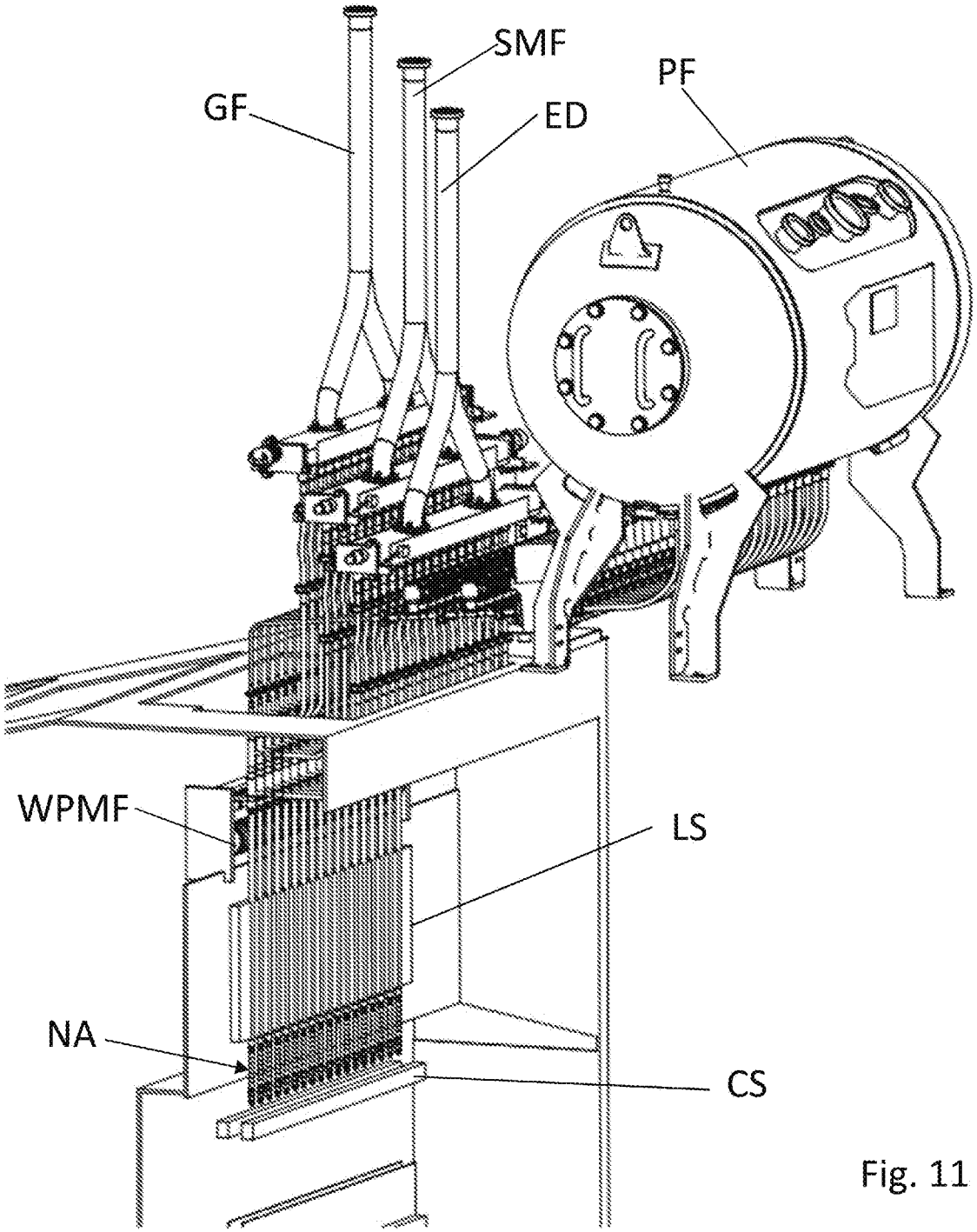
FIG. 11 shows an aseptic packaging machine including a plurality of the nozzle assemblies.

FIG. 11 shows an aseptic packaging machine that is equipped with a number of the nozzle assemblies NA, that are positioned next to each other. For each nozzle assembly NA, the machine comprises web-shaped packaging material feeds WPMF, for example wound around reels, from where webs of the packaging material can get guided towards the respective form sections. The machine further comprises a product supply feed PF, for example a tank, that is filled with sterile product and that is connectable via hoses, pipes or the like, to the product inlet connectors. The machine also comprises a sterilization medium supply feed SMF, for example leading to a tank, that is filled with sterilization medium and that is connectable via hoses, pipes or the like, to the sterilization medium inlet connectors. The machine furthermore comprises a gas supply feed GF, for example leading to a compressor, that is connectable via hoses, pipes or the like, to the gas inlet connectors. And the machine comprises an exhaust drain ED, that is used to subtract sterilization medium and sterile gas, and for example exhaust it to the environment and that is connectable via hoses, pipes or the like, to the exhaust outlet connectors.

At a position sideways of the form sections, a longitudinal sealer LS is provided that is designed to continuously make fin seals to the packaging tubes, for example by having their opposing longitudinal edges getting continuously guided along or through heated portions of the sealer LS for connecting them with each other.

At a position downstream of the nozzle assemblies, a cross-sealer CS is provided that is designed to make cross seals into filled sections of the packaging tubes, for example by having two heated portions of operable press jaws that are positioned at opposing sides of the filled packaging tubes getting pressed towards each other for connecting opposing wall sections of the filled packaging tubes with each other.

Before operation starts, the product outlet portion 4, the gas outlet portion 10, the sterilization medium outlet portion 16, and the exhaust inlet portion 22, get pre-sterilized. This can be done in various ways, for example with or without the formed packaging tube of packaging material already around them.

Figure 12:
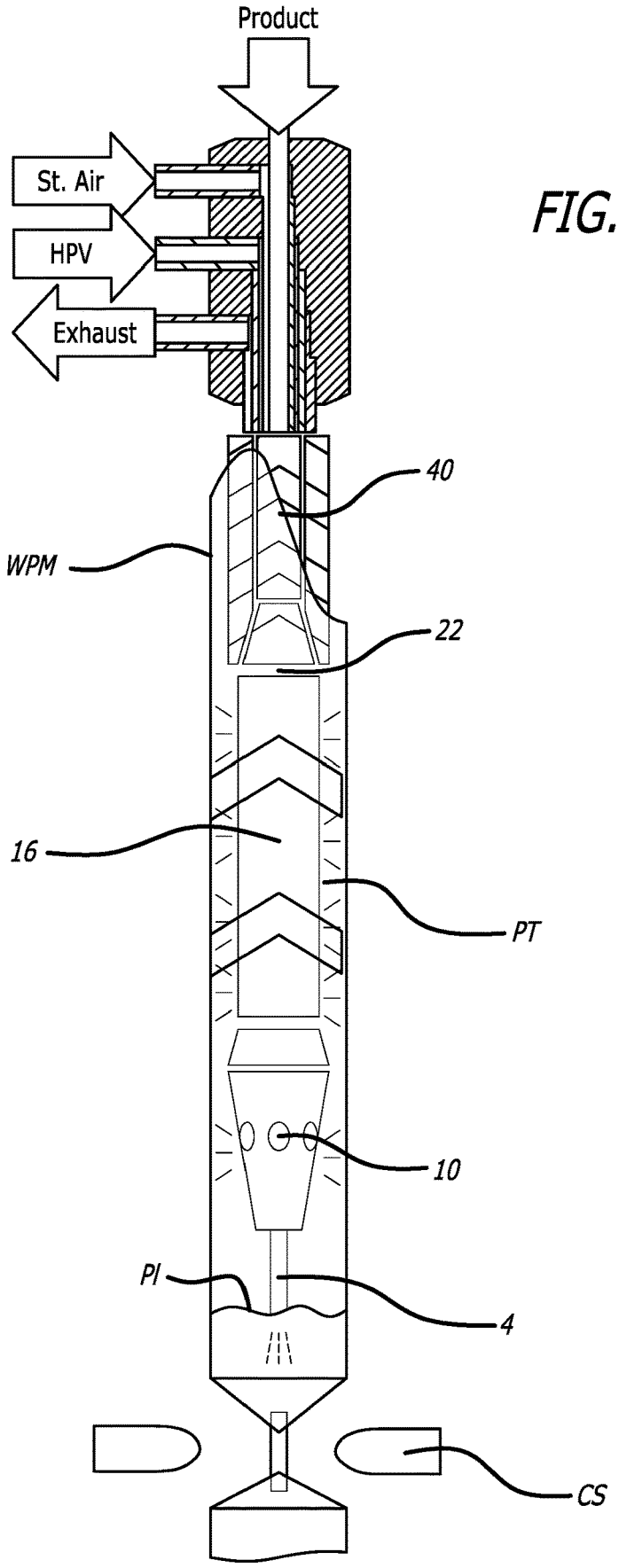
FIG. 12 schematically shows the sterilizing-filling process during production with the nozzle assembly of FIG. 1.

After the pre-sterilization has been completed, the actual sterilizing-filling process of the packaging tube can be (re)started. This is shown in FIG. 12. Web-shaped packaging material WPM is fed towards the form section 40 and there formed into the packaging tube PT, while having its fin seal formed. Pressurized sterile product starts flowing through the product supply duct and via the outlet opening in the product outlet portion 4 into the packaging tube PT. At a same time pressurized sterile gas (air) starts flowing through the gas supply duct 8 and via the outlet holes in the gas outlet portion 10 into the packaging tube PT at a position above a product interface PI, and pressurized sterilization medium starts flowing through the sterilization medium supply duct and via the outlet holes in the sterilization medium outlet portion 16 into the packaging tube PT at the position above the gas outlet holes. Simultaneously, a vacuum force gets exerted through the exhaust duct and via the exhaust inlet holes in the exhaust inlet portion 22 to the packaging tube's interior at a position above the sterilization medium outlet holes such that used sterilization medium and gas get drained away.

The pressures of the product, gas and sterilization medium, as well as the vacuum force, get tuned relative to each other in such a way that the injected product forms the product interface PI that lies downstream of the gas outlet holes 44, while at a same time the injected gas forms a gas barrier on top of the product interface PI, while overflow of injected gas flows towards the exhaust inlet holes 37 while drying the packaging tube's interior wall and while taking along the injected sterilization medium to also flow towards the exhaust inlet holes 37 while sterilizing the packaging tube's interior walls.

Figure 13:
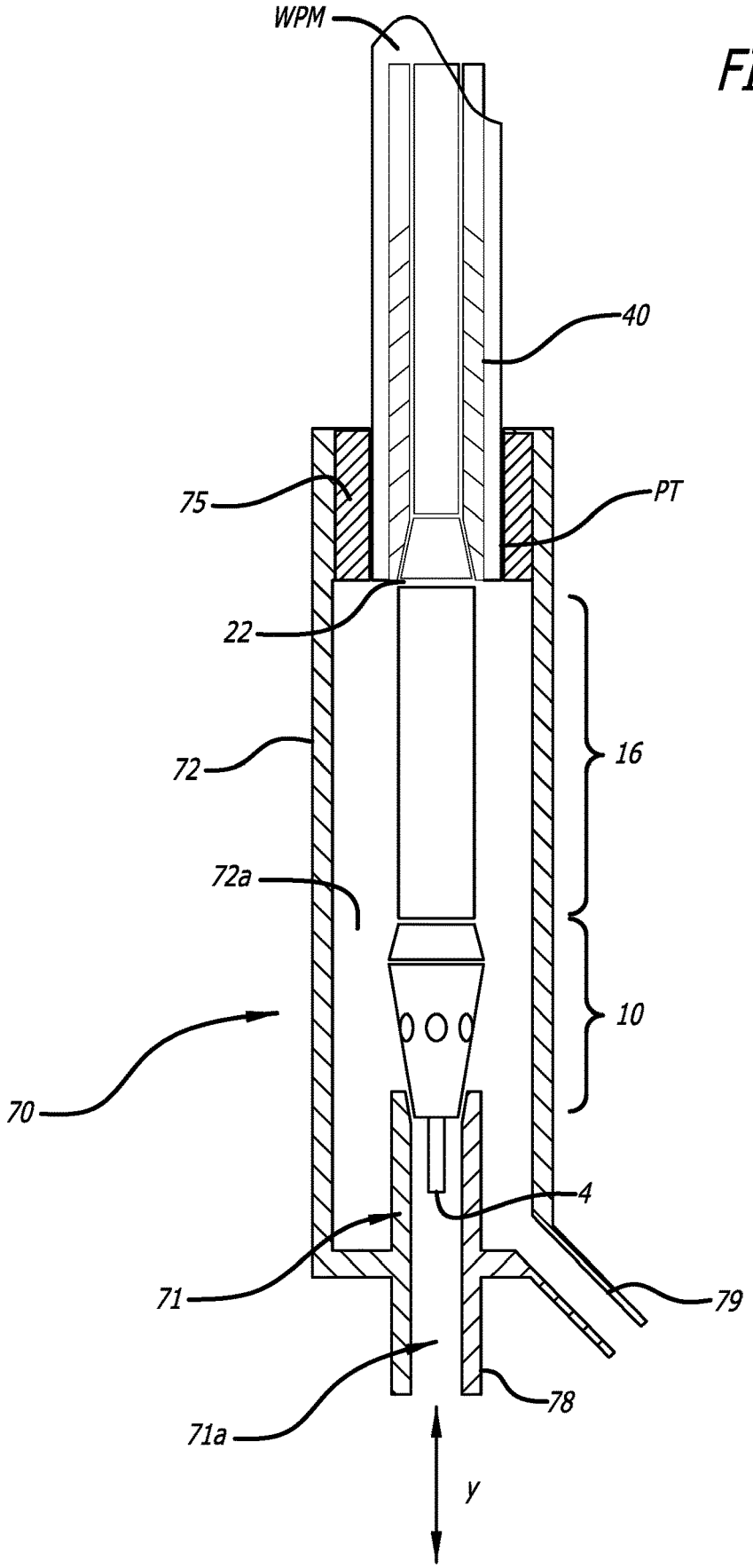
FIG. 13 shows a schematic view of a lower part of the sterilizer-filler nozzle assembly of FIGS. 1-10 and a collector cup.

In FIG. 13 a filling zone of the nozzle assembly is shown, that needs to be pre-sterilized before the actual production can begin of continuously starting to fill formed sterilized packaging tubes with sterile product, like a food or pharmaceutical product, in particular a liquid food or pharmaceutical product, as described here above. This filling zone comprises the product outlet portion 4, the gas outlet portion 10, the sterilization medium outlet portion 16 and the exhaust inlet portion 22.

A collector cup 70 is provided that comprises a first circumferential wall 71 that delimits a first interior space 71*a*, and a second circumferential wall 72 that delimits a second interior space 72*a*. The first interior space 71*a* is configured to enclose the product outlet portion 4 in the docking position that is shown in FIG. 13. The second interior space 72*a* is configured to enclose the gas outlet portion 10, the sterilization medium outlet portion 16 and the exhaust inlet portion 22 in the docking position that is shown in FIG. 13.

A sealing element (not shown) can be provided at an upper transitional wall part of the first circumferential wall 71. The upper transitional wall part is designed to come to lie sealing around and against an outer circumferential wall part of a distal end of the gas outlet portion 10, downstream of the gas outlet holes 44 therein.

An operable gripper 75 is provided at an upper wall part of the second circumferential wall 72. The gripper 75 is configured to releasably grip a fin seal of the formed packaging tube that lies along the form section 40. For this the gripper 75 is provided with opposing semi-cylindrical parts that are configured to grip around the form section and onto the formed packaging tube in the docking position that is shown in FIG. 11.

The first interior space 71*a* is provided at its lower end with a first drain 78 that is connectable via a hose, pipe or the like, to one or more suitable storages, filters or the like for further treatment of one or more types of cleaning and/or pre-sterilization medium that may get used during cleaning and/or pre-sterilization phases. The second interior space 72*a* is provided at its lower end with a second drain 79 that is connectable via a hose, pipe or the like, to suitable storages, filters or the like for further treatment of one or more types of cleaning and/or pre-sterilization medium that may get used during the cleaning and/or pre-sterilization phases.

The collector cup 70 is movable up and down in the axial direction y relative to the nozzle assembly from the docking position towards an inactive position in which the collector cup 70 has come to lie at a lower position underneath the nozzle assembly where it cannot interfere with the actual production of filling formed sterilized packaging tubes with sterile product and making cross seals into them.

A possible mode of operation for the collector cup 70 and the nozzle assembly during the cleaning and pre-sterilization phases shall now be described with reference to FIG. 14.

In FIG. 14.1 the nozzle assembly is shown ready to be cleaned and pre-sterilized. A free end of a web-shaped packaging material gets fed from a packaging material feed PF and then gets (manually) formed into a tubular shape around the form section 40 while having its longitudinal edge sealed together in order to form a so-called fin seal. This is shown in FIG. 14.2.

Subsequently the collector cup 70 starts to move upwards. During this upward movement the gripper 75 is in an open position such that it has enough play to freely position itself around the free lower end of the formed packaging tube PT that lies along the form section 40. This is shown in FIG. 14.3.

As soon as the upper transitional wall part of the first circumferential wall 71 has come to lie sealing around and against the distal end of the gas outlet portion 10, the docking position is reached. In this docking position, the gripper 75 has come to lie around the free lower end of the packaging tube PT. Furthermore, in this docking position, the collector cup 70 has gotten to enclose the product outlet portion 4 inside the first interior space 71*a*, while it has gotten to enclose the gas outlet portion 10, the sterilization medium outlet portion 16 and the exhaust inlet portion 22 inside the second interior space 72*a*. This is shown in FIG. 14.4.

Subsequently the gripper 75 gets operated to move towards its gripping position in which it firmly grips the fin seal of the formed packaging tube PT. This is shown in FIG. 14.5.

Then the cleaning process gets started during which the product supply duct 2 gets fed with lye and acid, whereas the gas supply duct 8 and the sterilization medium supply duct 14 if deemed necessary may get fed with warm water. The lye and acid then get to flush through and along the product outlet portion 4, before getting drained away by gravitational forces via the first drain 78. The warm water then may get to flush through and along the sterilization medium outlet portion 16 and the gas outlet portion 10 before getting drained away by gravitational forces via the second drain 79. This is shown in FIG. 14.6.

Then the pre-sterilization process gets started, during a first phase of which the product supply duct 2 gets fed with hot steam, whereas the gas supply duct 8 and the exhaust duct 20 get fed with dry air, and the sterilization medium supply duct 14 gets fed with HPV. The hot steam then gets to flow through and along the product outlet portion 4, before getting drained away via the first drain 78. The dry air and the HPV then get to flow through and along the exhaust inlet portion 22, the sterilization medium outlet portion 16 and the gas outlet portion 10 before getting drained away via the second drain 79. This is shown in FIG. 14.7.

Then a second phase of the pre-sterilization process gets started, during which the product supply duct 2 gets fed with product, whereas the gas supply duct 8 and the sterilization medium supply duct 14 get fed with HPV. Furthermore the second drain 79 then gets closed and the exhaust duct 20 gets activated by having a suction force exerted onto its exhaust outlet connector. The product then gets to flow out of the product outlet portion 4, before flowing away via the first drain 78. The HPV then gets to flow through and along the gas outlet portion 10 and the sterilization medium outlet portion 16 before getting exhausted via the exhaust inlet portion 22. This is shown in FIG. 14.8.

After a certain period of time that is deemed sufficient for obtaining an aimed degree of pre-sterilization, the collector cup 70 gets moved downwards towards its inactive position.

During this downwards moving the gripper 75 remains in its gripping position. Since the gripper 75 is fixedly connected to the collector cup 70, this causes the collector cup 70 to pull the formed packaging tube PT along with it. During this downward movement while pulling along the packaging tube PT, the product supply duct 2 remains being fed with product, whereas the sterilization medium supply duct 14 remains being fed with HPV, while the gas supply duct 8 gets fed with sterile air. In this way, newly formed packaging tube PT, that starts leaving the form section 40, gets continuously sterilized with HPV and dried with sterile air. This is shown in FIG. 14.9.

As soon as the collector cup 70 has reached its inactive position while having pulled the packaging tube PT over the exhaust inlet portion 22, over the sterilization medium outlet portion 16, over the gas outlet portion 10 as well as over the product outlet portion 4, cross seal heads CS get operated to make a cross seal into the packaging material. This is shown in FIG. 14.10.

From then on the critical filling zone is cleaned and pre-sterilized and can stay sterile. A pre-production cycle can then be started during which a certain number of packaging tubes already get formed, sterilized and filled. Those filled sticks can then be checked and if found well in order, the actual production can be started. This is shown in FIG. 14.11.

The operable gripper 75 can be based upon various principals, like for example one that makes use of vacuum forces that get to act on the outer side of the packaging tube.

Figure 15:
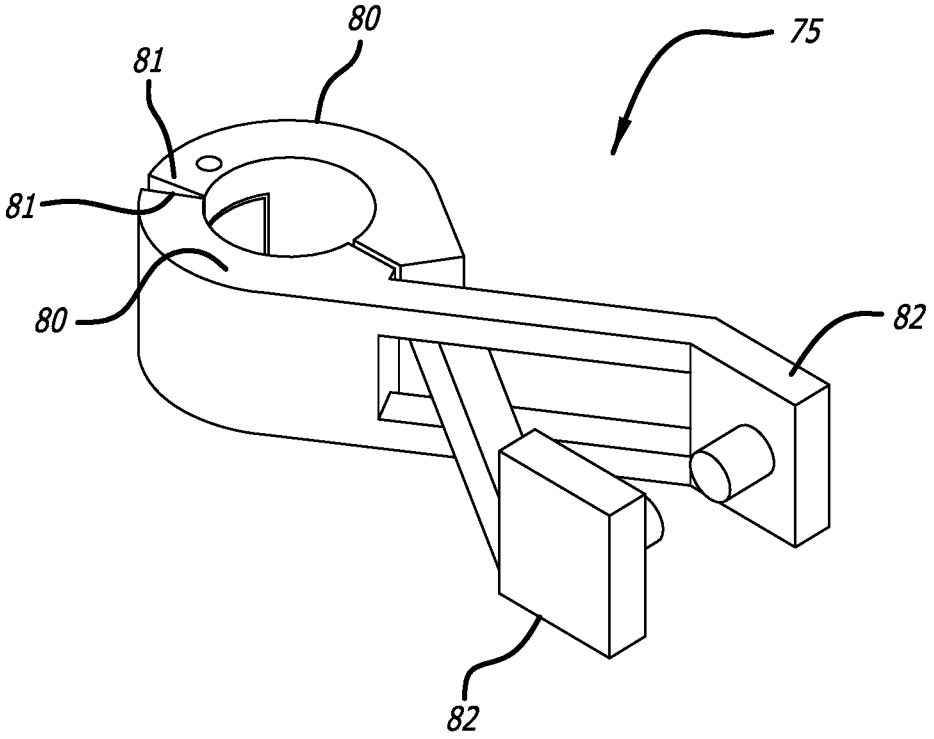
FIG. 15 shows a perspective view of an embodiment of the operable gripper in FIG. 13.

Preferably however use is made of a gripper 75 as is shown in FIG. 15. This gripper 75 comprises hingedly connected opposing semi-cylindrical parts 80 that are designed to, in the docking position, together grip around the form section 40 and onto the formed packaging tube PT. Furthermore, this operable gripper 75 comprises opposing jaw parts 81 that are designed to, in the docking position, together clamp the sealed longitudinal edge of the formed packaging tube PT. For operating the gripper 75 to move between its open position and its gripping position, it is provided with operating arms 82. A spring can be provided in between the outer ends of the arms 82 for biasing the gripper 75 either towards its open either towards its gripping position.

Besides the embodiments shown numerous variants are possible. For example the shape, dimensions and choice of materials of the respective parts of the nozzle assembly and collector cup may be changed.

Thus according to the invention collector cups for sterilizer-filler nozzle assemblies are provided with which new but, if desired also already existing aseptic packaging machines can easily and quickly be equipped.

While illustrative embodiments have been illustrated and described, it will be appreciated that various changes can be made therein without departing from the spirit and scope of the invention.

The embodiments of the invention in which an exclusive property or privilege is claimed are defined as follows:

1. An aseptic packaging machine comprising:

(a) a web-shaped packaging material feed;

(b) at least one sterilizer-filler nozzle assembly that comprises:

(i) a form section that has an outer wall, a proximal end and a distal end, which the outer wall is designed to form a packaging tube out of the web-shaped packaging material around the outer wall while the packaging tube moves downstream and while the packaging tube gets sealed along a longitudinal edge;

(ii) a product supply duct that extends at least partly through the form section;

has a product inlet portion which lies upstream of the distal end of the form section; and has a product outlet portion which lies downstream of the distal end of the form section;

(iii) a sterilization medium supply duct that extends at least partly through the form section;

has a sterilization medium inlet portion which lies upstream of the distal end of the form section; and has a sterilization medium outlet portion which lies between the distal end of the form section and the product outlet portion; and (iv) an exhaust duct that extends at least partly through the form section;

has an exhaust outlet portion which lies upstream of the distal end of the form section; and has an exhaust inlet portion which lies between the distal end of the form section and the product outlet portion, (c) a collector cup that is movable relative to the nozzle assembly between an inactive position and a docking position, and (d) the collector cup delimiting one or more interior spaces that is/are designed to, in the docking position, enclose the product outlet portion to collect and/or drain away pre-sterilization media that during a pre-sterilization of the nozzle assembly get to flow through and along the nozzle assembly.

2. The aseptic packaging machine according to claim 1, wherein the collector cup is designed to enclose at least one of the sterilization medium outlet portion and the exhaust inlet portion in said docking position inside the one or more interior spaces.

3. The aseptic packaging machine according to claim 1, wherein the collector cup comprises an operable gripper that is designed to, in the docking position, releasably grip a section of a formed packaging tube that lies along the form section.

4. The aseptic packaging machine according to claim 3, wherein the operable gripper comprises opposing arcuate parts that are designed to, in the docking position, together grip around the form section and onto the formed packaging tube.

5. The aseptic packaging machine according to claim 3, wherein the operable gripper comprises opposing jaw parts that are designed to, in the docking position, together clamp the sealed longitudinal edge of the formed packaging tube.

6. The aseptic packaging machine according to claim 1, wherein the collector cup is movable relative to the nozzle assembly from the docking position towards the inactive position along the product outlet portion and the sterilization medium outlet portion and/or exhaust inlet portion while having an operable gripper pull the formed packaging tube along with the operable gripper over the product outlet portion and the sterilization medium outlet portion and/or the exhaust inlet portion.

7. The aseptic packaging machine according to claim 1, wherein the collector cup delimits a first and second one of the interior spaces, wherein the first interior space is designed to, in the docking position, enclose the product outlet portion, and wherein the second interior space is designed to, in the docking position, enclose the sterilization medium outlet portion and/or the exhaust inlet portion.

8. The aseptic packaging machine according to claim 7, wherein the first interior space is equipped with a first drain, and wherein the second interior space is equipped with a second drain.

9. The aseptic packaging machine according to claim 7 wherein the collector cup is provided with a sealing element that is positioned at a transitional wall part of the collector cup that separates the first and second ones of the interior spaces from each other and that is designed to come to lie sealing around and against an outer circumferential wall part of the nozzle assembly that lies between the product outlet portion and the sterilization medium outlet portion and/or the exhaust inlet portion.

10. The aseptic packaging machine according to claim 1, wherein the sterilization medium outlet portion is enclosed by an inner circumferential wall part of the collector cup that has an inner diameter that is at least two times larger than a largest cross-sectional dimension of the sterilization medium outlet portion.

11. The aseptic packaging machine according to claim 1, wherein the sterilizer-filler nozzle assembly further comprises:

a gas supply duct that:

extends at least partly through the form section;

has a gas inlet portion which lies upstream of the distal end of the form section; and has a gas outlet portion which lies between the sterilization medium outlet portion and the product outlet portion;

wherein the collector cup is further designed to also enclose the gas outlet portion inside the one or more interior spaces, and wherein one or more pre-sterilization medium supply feeds is/are also connectable to the gas inlet portion.

12. The aseptic packaging machine according to claim 11, wherein the gas outlet portion lies upstream adjacent the product outlet portion.

13. The aseptic packaging machine according to claim 12, wherein the sterilization medium outlet portion lies upstream adjacent the gas outlet portion and wherein the exhaust inlet portion lies upstream adjacent the sterilization medium outlet portion.

14. The aseptic packaging machine according to claim 1, further comprising one or more pre-sterilization medium supply feeds that is/are connectable to the product inlet portion and the sterilization medium inlet portion.

15. A method for pre-sterilization of an aseptic packaging machine according to claim 1, comprising the steps of:

positioning the collector cup into the docking position relative to the nozzle assembly;

connecting the one or more pre-sterilization medium supply feeds to the product inlet portion and the sterilization medium inlet portion;

having the pre-sterilization medium flow through the product supply duct and via the product outlet portion into the collector cup; and positioning the collector cup into the inactive position relative to the nozzle assembly.

16. The method according to claim 15, wherein an operable gripper of the collector cup, after having been positioned in the docking position, releasably grips a section of the formed packaging tube that lies along the form section.

17. The method according to claim 16, wherein the collector cup, during movement from the collector cup docking position towards the inactive position, has the operable gripper pull the formed packaging tube along with the gripper over the product outlet portion and the sterilization medium outlet portion and/or the exhaust inlet portion.

* * * * *